US009951453B2

(12) United States Patent
Jeon et al.

(10) Patent No.: US 9,951,453 B2
(45) Date of Patent: Apr. 24, 2018

(54) WASHING MACHINE AND METHOD OF MANUFACTURING WASHING TUB BEING PROVIDED THEREIN

(71) Applicant: Samsung Electronics Co., Ltd., Suwon-si (KR)

(72) Inventors: Jong Su Jeon, Seongnam-si (KR); Young Jin Um, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 391 days.

(21) Appl. No.: 14/580,986

(22) Filed: Dec. 23, 2014

(65) Prior Publication Data

US 2015/0252512 A1 Sep. 10, 2015

(30) Foreign Application Priority Data

Mar. 7, 2014 (KR) ..... 10-2014-0027300

(51) Int. Cl.

| | |
|---|---|
| ***D06F 37/12*** | (2006.01) |
| ***D06F 37/14*** | (2006.01) |
| ***D06F 37/26*** | (2006.01) |
| ***D06F 39/12*** | (2006.01) |

(52) U.S. Cl.

CPC ..... *D06F 37/12* (2013.01); *D06F 37/14* (2013.01); *D06F 37/145* (2013.01); *D06F 37/264* (2013.01); *D06F 39/12* (2013.01); *D06F 39/125* (2013.01); *Y10T 29/496* (2015.01)

(58) Field of Classification Search

CPC ..... D06F 37/12; D06F 37/14; D06F 37/145; D06F 37/264; D06F 39/12; D06F 39/125; Y10T 29/496

USPC ..... 68/132, 133, 139, 142, 143, 144

See application file for complete search history.

(56) References Cited

U.S. PATENT DOCUMENTS

2008/0005925 A1* 1/2008 Fumagalli ..... D06F 37/04 34/596

FOREIGN PATENT DOCUMENTS

KR 10-2004-0068235 7/2004

* cited by examiner

*Primary Examiner* — Levon J Shahinian

(74) *Attorney, Agent, or Firm* — Staas & Halsey LLP

(57) ABSTRACT

A washing machine may include a washing tub that is capable of improving washing effect. The washing machine includes: a casing; a washing tub installed in the casing; a plurality of concave sides formed to be recessed into an inner side surface of the washing tub; and a plurality of protrusions that protrude in an inward direction of the washing tub and include a plurality of first protrusions formed on the plurality of concave sides. A frictional force with laundry is generated using a washing tub including the plurality of protrusions and the plurality of concave sides so that a washing force can be enhanced and a flow of washing water can be guided.

20 Claims, 7 Drawing Sheets

WASHING MACHINE AND METHOD OF MANUFACTURING WASHING TUB BEING PROVIDED THEREIN

CROSS-REFERENCE TO RELATED APPLICATIONS

This application claims the priority benefit of Korean Patent Application No. 10-2014-0027300, filed on Mar. 7, 2014 in the Korean Intellectual Property Office, the disclosure of which is incorporated herein by reference.

BACKGROUND

1. Field

Embodiments relate to a washing machine, and more particularly, to a washing machine including a washing tub that is capable of improving washing effect.

2. Description of the Related Art

In general, a washing machine is classified as a pulsator type washing machine and a drum type washing machine according to a washing method. Both the pulsator type washing machine and the drum type washing machine include a tub and a washing tub.

In the pulsator type washing machine, a rotation shaft of the washing tub in which washing is to be performed, is provided perpendicular to the ground. A pulsator for generating a washing water current is installed at a lower portion of the washing tub. In the pulsator type washing machine, the pulsator is rotated by a motor in a state in which laundry and detergent water are put into the washing tub, and the laundry put into the washing tub is agitated together with washing water so that dirt stained on the laundry can be removed.

In the drum type washing machine, washing is performed by a fall. A lifter is disposed in the washing tub so as to lift the laundry in an upward direction.

In the pulsator type washing machine and the drum type washing machine, through holes through which water in the tub can be introduced into the washing tub and water in the washing tub can be discharged from the washing tub when drainage and dehydration operations are performed, are provided in a circumference of the washing tub.

In the related art, through holes are arranged in an inner surface of a flat washing tub. In this case, friction between the inner surface of the washing tub and the laundry is not large, which causes a limitation in improving washing effect caused by friction.

Also, in order to solve the problem, protrusions that protrude in an inward direction of the washing tub are formed. However, a height of each of the protrusions is low, and a contact area between the protrusions and the laundry is small, which is less effective.

SUMMARY

In an aspect of one or more embodiments, there is provided a washing machine having an improved structure of a washing tub in which a washing force and a dehydration force of laundry can be enhanced.

In an aspect of one or more embodiments, there is provided a washing machine that is capable of forming a soft image by forming circular protrusions and patterns of concave sides that extend in a swirl shape.

In an aspect of one or more embodiments, there is provided a washing machine which may include a casing; a washing tub installed in the casing; a plurality of concave sides formed to be recessed into an inner side surface of the washing tub; and a plurality of protrusions that protrude in an inward direction of the washing tub and include a plurality of first protrusions formed on the plurality of concave sides.

The plurality of concave sides may be formed to extend from one end to the other end of the washing tub so as to guide a flow of washing water.

The plurality of concave sides may extend to be inclined to one side.

The washing tub may be rotatably installed, and the plurality of concave sides may be formed to be inclined in an opposite direction to a dehydration direction of the washing tub.

The plurality of concave sides may be formed to extend in a swirl shape.

The plurality of concave sides may extend in a form of a curve, and a curvature of the curve may vary.

The plurality of concave sides may be formed at at least a portion of the inner side surface of the washing tub.

The plurality of protrusions may be disposed to be spaced apart from each other by a predetermined gap, and exterior parts of the plurality of protrusions may be provided in a circular shape.

The plurality of protrusions may include: a plurality of first protrusions that protrude from the plurality of concave sides; and a plurality of second protrusions that protrude from the inner side surface of the washing tub.

The plurality of second protrusions may protrude more in the inward direction of the washing tub than the plurality of first protrusions.

The plurality of concave sides may extend along the plurality of first protrusions.

The plurality of protrusions may be provided to have a plurality of rows and columns, and each of the concave sides may extend along each of the first protrusions arranged in different rows and columns.

The washing machine may further include a plurality of through holes provided between the plurality of protrusions so as to perform drainage of the washing tub, wherein the plurality of protrusions may be disposed to be spaced apart from each other by a predetermined gap.

The plurality of through holes may be placed adjacent to each of the plurality of protrusions, and the plurality of through holes placed adjacent to the plurality of protrusions may be disposed to have a predetermined angle.

In an aspect of one or more embodiments, there is provided a washing machine which may include a tub; a washing tub installed in the tub so as to rotate around a vertical shaft; a plurality of protrusions that protrude in an inward direction of the washing tub; and a plurality of concave sides formed to be recessed into at least a portion of an inner side surface of the washing tub.

Each of the plurality of concave sides may extend to be inclined to one side along the plurality of protrusions.

The plurality of protrusions may be provided to have a plurality of rows and columns, and each of the protrusions provided in different rows and columns may be disposed at each of the plurality of concave sides.

The washing machine may further include a plurality of through holes provided adjacent to each of the protrusions so as to perform drainage of the washing tub, and the plurality of through holes adjacent to the plurality of protrusions may be disposed to be spaced apart from each other at a predetermined angle.

The washing machine may further include a plurality of through holes provided adjacent to each of the protrusions so as to perform drainage of the washing tub, and at least portions of the plurality of protrusions and the plurality of through holes may be disposed in each of the concave sides.

In an aspect of one or more embodiments, there is provided a method of manufacturing a washing tub being provided in a washing machine, which may include forming a plurality of through holes in a flat plate; pressurizing peripheral portions of the plurality of through holes from a first surface to a second surface and performing a burring process on the plurality of through holes; forming at least one pattern by pressurizing the first surface and the second surface of the flat plate having the plurality of through holes formed therein; cutting the flat plate having the at least one pattern formed therein to a predetermined length; and bending the cut flat plate and forming the flat plate in a cylindrical shape so that the first surface becomes an inner side surface.

The at least one pattern may include a plurality of protrusions that protrude from the first surface and a plurality of concave sides that are recessed into the first surface.

The plurality of protrusions and the plurality of concave sides may be simultaneously formed.

The plurality of protrusions may include a plurality of first protrusions formed together with the plurality of concave sides and a plurality of second protrusions formed on the flat plate.

The plurality of concave sides may be formed at at least a portion of the flat plate.

The plurality of protrusions may be formed between the through holes.

At least portions of the plurality of protrusions and the plurality of through holes may be placed on the plurality of concave sides.

The plurality of concave sides may extend in a form of a curve from a lower portion of the washing tub to an upper portion of the washing tub at a first angle, a second angle and a third angle.

The first angle and the third angle may be equal to each other and inclined at a larger angle than the second angle with respect to the bottom surface of the washing tub.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
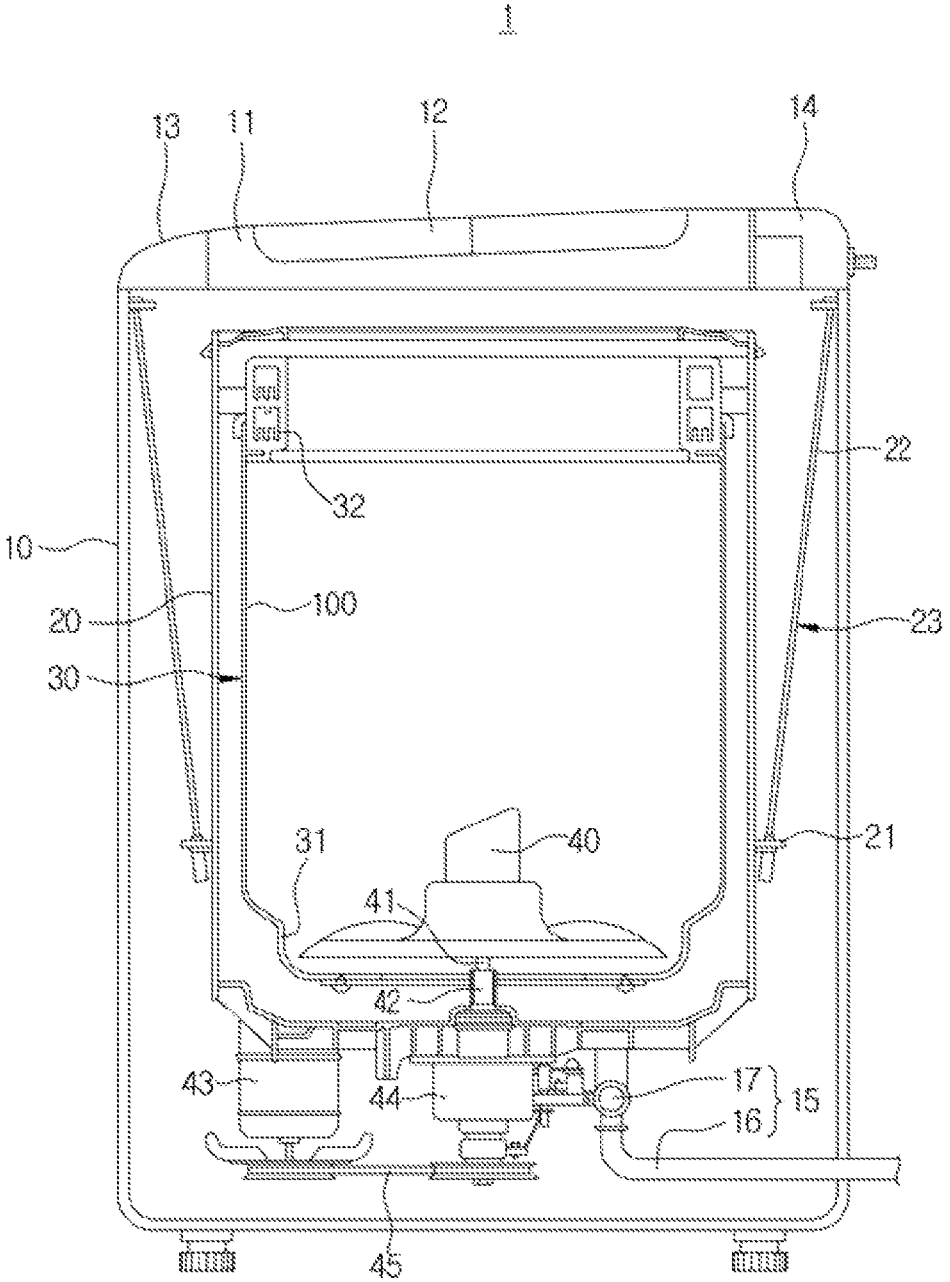
FIG. 1 illustrates a washing machine according to an embodiment.

Reference will now be made in detail to embodiments, examples of which are illustrated in the accompanying drawings, wherein like reference numerals refer to like elements throughout.

FIG. 1 is a cross-sectional view of a washing machine 1 according to an embodiment.

The washing machine 1 may include a casing 10, a tub 20 that is installed in the casing 10, and a washing tub 30 that is installed in the tub 20. The tub 20 may be provided to accommodate washing water, and the washing tub 30 may be provided to accommodate laundry.

The casing 10 constitutes an exterior of a shape of a box in which a top surface of the casing 10 is opened, and a cover 11 is coupled to the open top surface of the casing 10. The cover 11 may include a door 12 through which a user may put the laundry into the casing 10 or take out the laundry from the casing 10.

A control panel 13 may be provided on a front surface of the cover 11 so as to control the washing machine 1. Various button portions (not shown) through which a user's desired washing mode is input, and a display unit (not shown) for displaying an operating state of the washing machine 1 and the user's manipulation state may be disposed in front of the control panel 13.

An electronic component accommodation portion 14 in which various electronic components related to an operation of the washing machine 1 are installed, may be provided in the rear of the cover 11. The electronic component accommodation portion 14 may be formed to be recessed into the rear of the cover 11 so that electronic components, such as a control unit, a water supply valve, and the like, can be installed at the electronic component accommodation portion 14.

A water supply unit (not shown) may be installed at one side of an upper portion of the casing 10, and a drainage unit 15 may be installed at one side of a lower portion of the casing 10. The drainage unit 15 may include a drainage pipe 16 and a drainage valve 17 for discharging washing water stored in the tub 20 to the outside.

The tub 20 may be installed in the center of an inside of the casing 10 so that washing water can be supplied to the tub 20 via the water supply unit (not shown). The tub 20 may have a cylindrical structure in which washing water can be accommodated, and washing water can be supplied to the tub 20 via an open upper portion of the tub 20. A lower portion of the tub 20 may be connected to the drainage pipe 16 so as to discharge accommodated washing water to the outside.

The tub 20 may be installed at the casing 10 and may be supported by a suspension unit 23. Four suspension units 23 may be generally provided to suspend the tub 20 at the casing 10 and to support the tub 20. The suspension unit 23 may include a support rod 22 that connects the casing 10 and the tub 20 and a fixing bracket 21 that couples the support rod 22 to the tub 20. A plurality of fixing brackets 21 may be disposed at an outer side of the lower portion of the tub 20 at regular intervals.

The washing tub 30 may be rotatably installed in the tub 20. An upper portion of the washing tub 30 may be opened so as to accommodate washing water and the laundry. A balancer 32 that offsets an unbalanced load caused by rotation of the washing tub 30 may be provided at the upper portion of the washing tub 30.

The washing tub 30 may include a cylindrical portion 100 that constitutes sides of the washing tub 30 and a bottom surface 31 that constitutes a lower portion of the washing tub 30. A pulsator 40 may be installed on the bottom surface 31 so as to generate a washing water current. The pulsator 40 is used to agitate the laundry put into the washing tub 30 together with washing water. The pulsator 40 is supported by a washing shaft 41 and is rotatably installed in the center of the lower portion of the washing tub 30. A dehydration shaft 42 may be coupled to the lower portion of the washing tub 30 and may be connected to a clutch unit 44.

The clutch unit 44 may be installed adjacent to a driving motor 43 that is disposed at a lower portion of an outer side of the tub 20 so as to drive the washing tub 30 and the pulsator 40. The clutch unit 44 may be connected to the driving motor 43 via a driving belt 45, and power of the driving motor 43 may be transmitted to the clutch unit 44. The clutch unit 44 may rotate the dehydration shaft 42 and the washing shaft 41 selectively. Also, the clutch unit 44 may serve as a brake that reduces a rotation speed of the pulsator 40 and stops rotation of the washing tub 30.

The entire washing procedure of the washing machine 1 will be described together with operations of elements. The laundry is accommodated in the washing tub 30, and washing water is supplied into the tub 20 together with a detergent. Thereafter, a driving force of the driving motor 43 is transmitted to the washing shaft 41 via the clutch unit 44 so that the pulsator 40 can be rotated. The laundry in the washing tub 30 is agitated with washing water by means of rotation of the pulsator 40 so that a washing operation can be performed. In an embodiment, the pulsator 40 may be alternately rotated clockwise and counterclockwise.

If the washing operation is finished, washing water stored in the tub 20 is discharged to the outside via the drainage pipe 16. If washing water is discharged, only the wet laundry remains in the washing tub 30, and the driving force of the driving motor 43 is transmitted to the dehydration shaft 42 via the clutch unit 44, and if the washing tub 30 is rotated, water is taken out from the laundry due to a centrifugal force. In an embodiment, the washing tub 30 can be rotated at a high speed in one direction, for example, clockwise.

When dehydration is performed, a plurality of through holes may be provided in the washing tub 30 so that water can be taken out from the washing tub 30. A shape of patterns of the washing tub 30 for enhancing a washing force and dehydration efficiency will be described.

Figure 2:
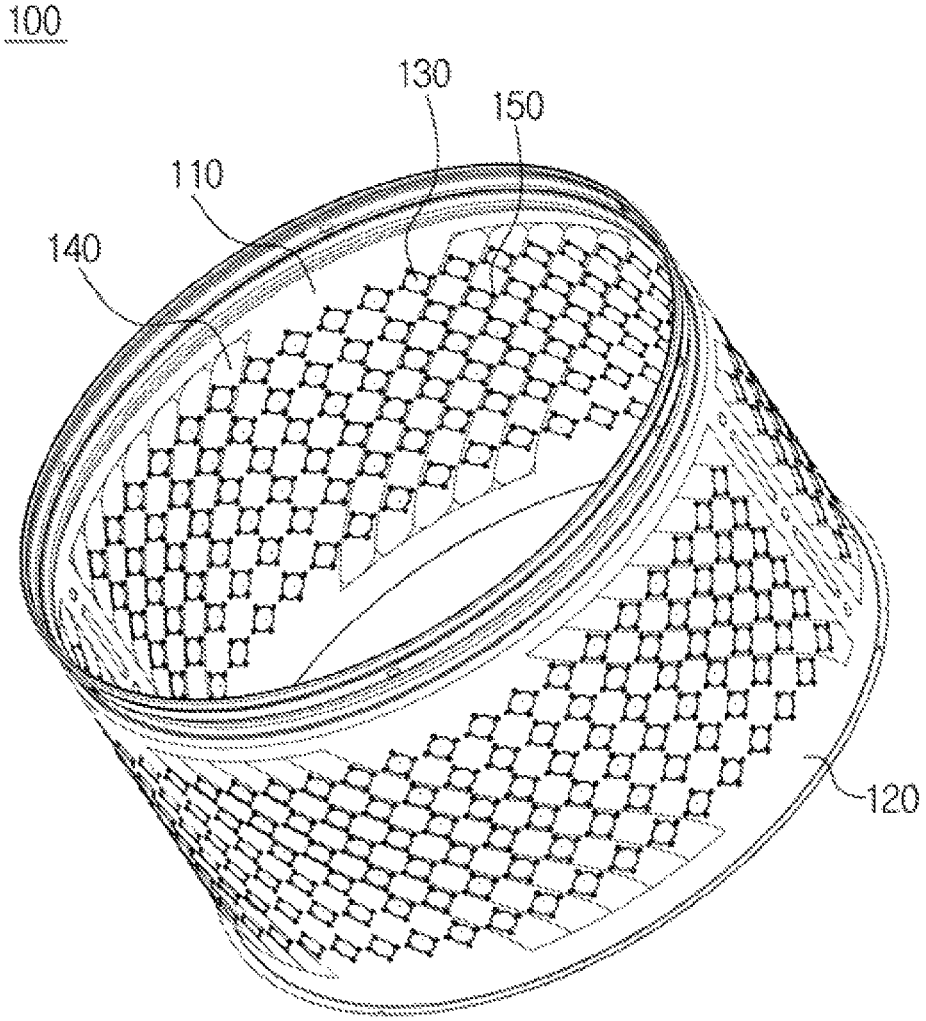
FIG. 2 illustrates a cylindrical portion of a washing tub being provided in the washing machine illustrated in FIG. 1.
Figure 3:
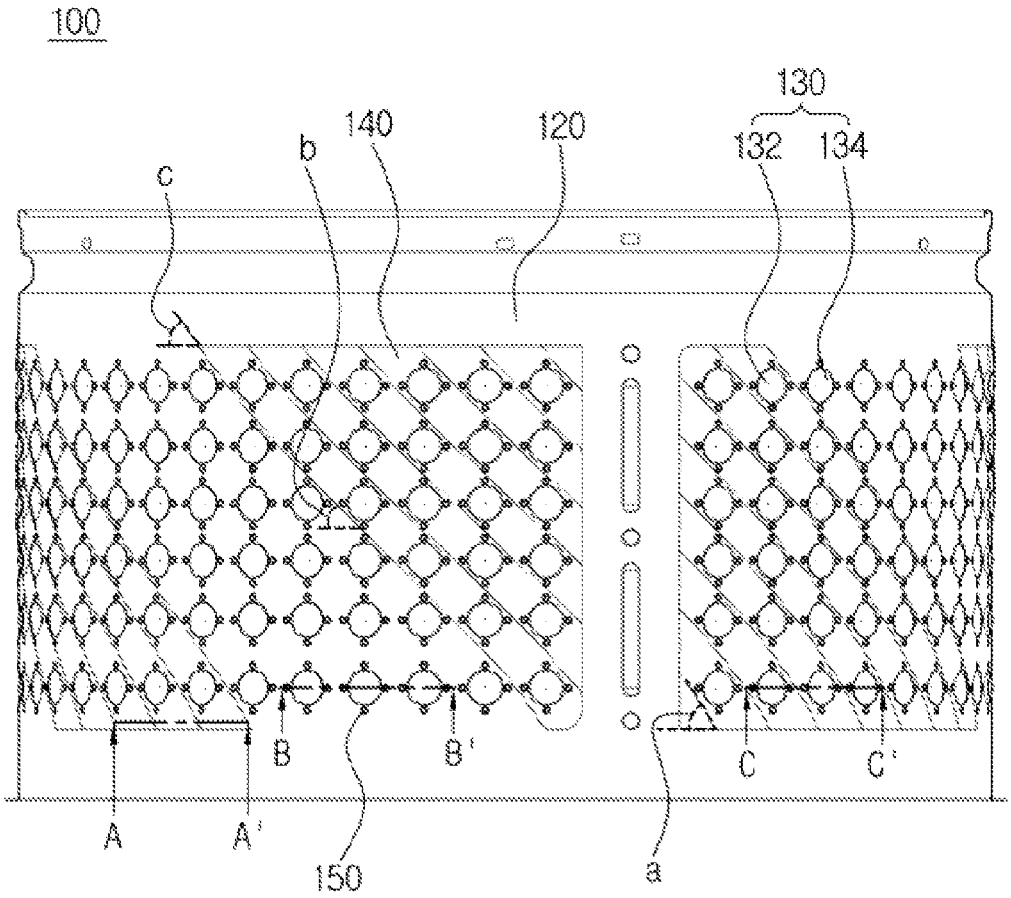
FIG. 3 is a front view of an inner side of the cylindrical portion of the washing tub of FIG. 1.

FIG. 2 illustrates the cylindrical portion 100 of the washing tub 30 provided in the washing machine 1 illustrated in FIG. 1, and FIG. 3 is a front view of an inner side of the cylindrical portion 100 of the washing tub 30 of FIG. 1. In FIGS. 2 and 3, the cylindrical portion 100 is illustrated while other configurations of the washing tub 30 are omitted.

The cylindrical portion 100 may be provided to have a predetermined thickness and may include an inner side surface 110 and an outer side surface 120. The inner side surface 110 is a surface that contacts the laundry, and the outer side surface 120 is a surface that is placed adjacent to the tub 20. The inner side surface 110 and the outer side surface 120 are provided as surfaces that correspond to each other. However, since the shape of the inner side surface 110 relates to the washing force and dehydration efficiency, a description based on the inner side surface 110 will be provided.

At least one pattern may be formed on the inner side surface 110, and patterns may include a plurality of concave sides 140 and a plurality of protrusions 130. The plurality of concave sides 140 may be formed to be recessed into the inner side surface 110. The plurality of protrusions 130 may be formed to protrude in an inward direction of the washing tub 30.

The plurality of concave sides 140 may be formed to extend from one end to the other end of the cylindrical portion 100. When washing and dehydration are performed, the level of flowing washing water may be increased to an upper portion of the washing tub 30 along the plurality of concave sides 140. That is, the plurality of concave sides 140 may guide the flow of washing water.

In order to guide the flow of washing water, the plurality of concave sides 140 may be provided in various shapes. As illustrated in FIGS. 2 and 3, the plurality of concave sides 140 may extend to be inclined toward one side.

Also, the plurality of concave sides 140 may extend in the form of a curve, and a curvature of the curve may vary. For example, the plurality of concave sides 140 may be formed to extend in a swirl shape. As illustrated in FIG. 3, the concave sides 140 extend from the lower portion to the upper portion of the washing tub 30 at a first angle a, a second angle b, and a third angle c. In an embodiment, the first angle a and the third angle c may be provided to be equal to each other and may be inclined at a larger angle than the second angle b with respect to the bottom surface 31.

When a washing operation is performed, the pulsator 40 is alternately rotated clockwise and counterclockwise. Thus, washing water to which the centrifugal force is transmitted, may also flow. The level of washing water that contacts the inner side surface 110 may be increased to the upper portion of the washing tub 30 or may be reduced along the concave sides 140, and washing water may flow efficiently.

When a dehydration operation is performed, the washing tub 30 is rotated in one direction and separates washing water and the laundry from each other. In an embodiment, the plurality of concave sides 140 may be formed to be inclined in an opposite direction to a dehydration direction of the washing tub 30. For example, the washing tub 30 may be rotated clockwise, and the concave sides 140 may extend to be inclined counterclockwise at the lower portion of the washing tub 30. Thus, the level of washing water to which the centrifugal force is transmitted, may be increased to the upper portion of the washing tub 30 along the concave sides 140, and washing water can be efficiently taken out from the washing tub 30.

Also, as illustrated in FIGS. 2 and 3, the plurality of concave sides 140 may be formed at at least a portion of the inner side surface 110 of the washing tub 30. Thus, the inner side surface 110 may be provided as an uneven surface having no smooth exterior. The laundry may be rotated to contact the inner side surface 110 due to the centrifugal force, and a predetermined external force may be transmitted to a curve of the inner side surface 110. Thus, a phenomenon that the laundry is agglomerated and tangled while being rotated, can be prevented.

The plurality of protrusions 130 may be disposed at the inner side surface 110 to be spaced apart from each other by a predetermined gap. The plurality of protrusions 130 may be provided to have a plurality of rows and columns. The plurality of protrusions 130 may have various arrangement structures, and in FIGS. 2 and 3, the plurality of protrusions 130 arranged in a straight line side by side are illustrated.

Each of the plurality of protrusions 130 may be provided in various shapes including a polygonal shape. In FIGS. 2 and 3, the protrusions 130 including circular exterior parts are illustrated. Also, the protrusions 130 may protrude to have a predetermined angle with respect to the inner side surface 110, and FIGS. 2 and 3 illustrate the protrusions 130 that protrude in a circular shape.

A plurality of through holes 150 through which drainage of the washing tub 30 is to be performed, may be provided in the inner side surface 110. The plurality of through holes 150 may be placed adjacent to the plurality of protrusions 130. The through holes 150 may be provided between the protrusions 130 and may be disposed to be spaced apart from each other at a predetermined angle. For example, as illustrated in the drawings, four through holes 150 may be provided in the vicinity of one protrusion 130 so as to be spaced apart from each other at 90 degrees.

The plurality of protrusions 130 may include a plurality of first protrusions 132 that protrude from the plurality of concave sides 140 and a plurality of second protrusions 134 that protrude from the inner side surface 110. That is, the plurality of first protrusions 132 may be formed on the plurality of concave sides 140, and the concave sides 140 may extend along the first protrusions 132.

Each of the concave sides 140 may extend to be inclined toward one side along the plurality of first protrusions 132. For example, each concave side 140 may extend along each of the first protrusions 132 arranged in different rows and columns. As illustrated in FIG. 3, the concave sides 140 extend along the first protrusions 132 arranged in a diagonal line.

Figure 4:
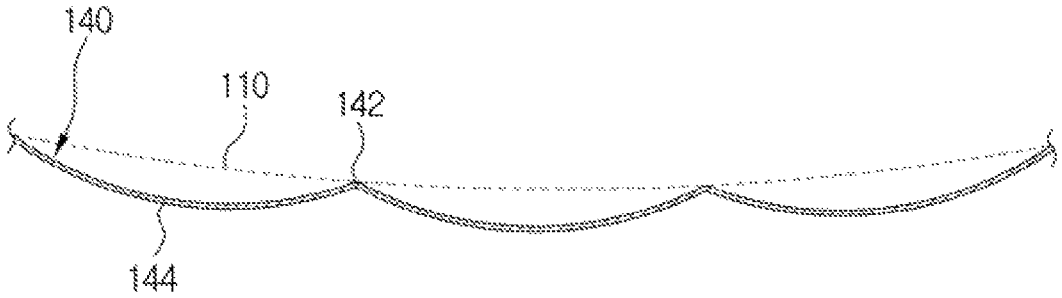
FIG. 4 is a cross-sectional view taken along line A-A' of FIG. 3.

FIG. 4 is a cross-sectional view taken along line A-A' of FIG. 3. FIG. 4 illustrates a cross-section of a concave side in which no protrusions are formed, and a dotted line represents the inner side surface 110 in which no concave sides 140 are formed.

The concave sides 140 include concave portions 144 recessed into the inner side surface 110 and connection portions 142 connected to the adjacent concave sides 140. A depth of each of the concave portions 144 may vary according to a design and a manufacturing process. The connection portions 142 may be placed in the same line as that of the inner side surface 110. The concave sides 140 may be formed to be recessed into the inner side surface 110 in various shapes, and the shape of the concave sides 140 is not limited to the shape shown in FIG. 4.

Figure 5:
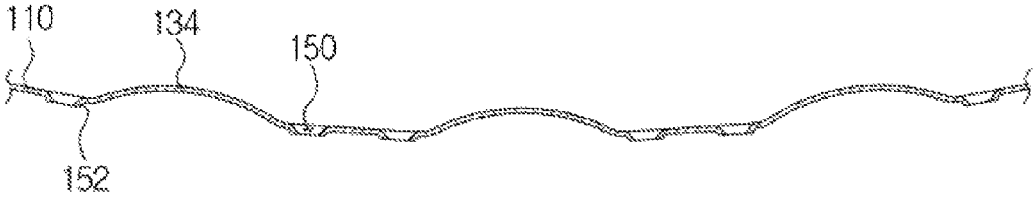
FIG. 5 is a cross-sectional view taken along line B-B' of FIG. 3.

FIG. 5 is a cross-sectional view taken along line B-B' of FIG. 3. FIG. 5 illustrates a cross-section of the protrusions 130 of the washing tub 30.

The protrusions 134 of FIG. 5 are formed at the inner side surface 110 in which no concave sides 140 are formed, and represent the second protrusions 134. The second protrusions 134 may protrude in an inward direction from the inner side surface 110, and a height of each flat surface protrusion 134 may vary according to a design and a manufacturing process. The through holes 150 are placed in both sides of each flat surface protrusion 134, and the through holes 150 may be formed along the inner side surface 110. The second protrusions 134 may be formed to protrude from the inner side surface 110 in various shapes, and the shape of the second protrusions 134 is not limited to the shape of FIG. 5.

Figure 6:
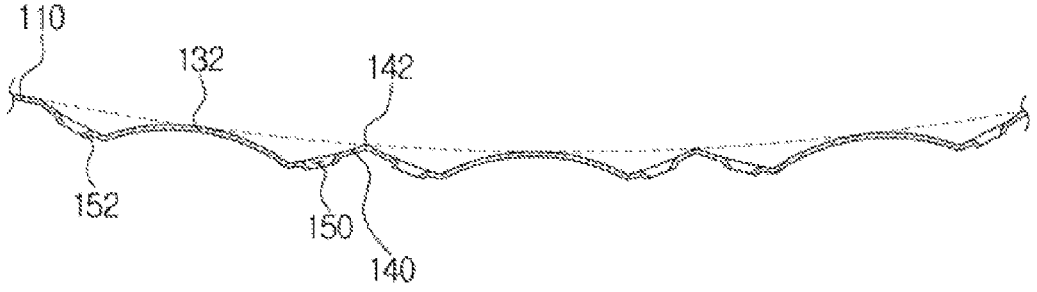
FIG. 6 is a cross-sectional view taken along line C-C' of FIG. 3.

FIG. 6 is a cross-sectional view taken along line C-C' of FIG. 3. FIG. 6 illustrates the concave sides 140 and the protrusions 130 of the washing tub 30.

The protrusions 132 of FIG. 6 are formed on the concave sides 140 and represent the first protrusions 132. The protrusions 132 have a shape in which the first protrusions 132 and the through holes 150 are additionally provided in the shape of the concave sides 140 of FIG. 4. The first protrusions 132 may protrude to correspond to the inner side surface 110 indicated by a dotted line. The through holes 150 may be placed at both sides of each curved surface protrusion 132 and may be formed according to the shape of the inclined concave side 140.

Since the first protrusions 132 are formed at the recessed concave sides 140, they may protrude less in the inward direction of the washing tub 30 than the second protrusions 134. That is, even when the first protrusions 132 and the second protrusions 134 are provided to have the same shapes, the second protrusions 134 protrude more in the inward direction of the washing tub 30 than the first protrusions 132 formed at the recessed concave sides 140. Thus, uneven portions may be formed at the inner side surface 110 and thus, the washing force can be enhanced.

Figure 7:
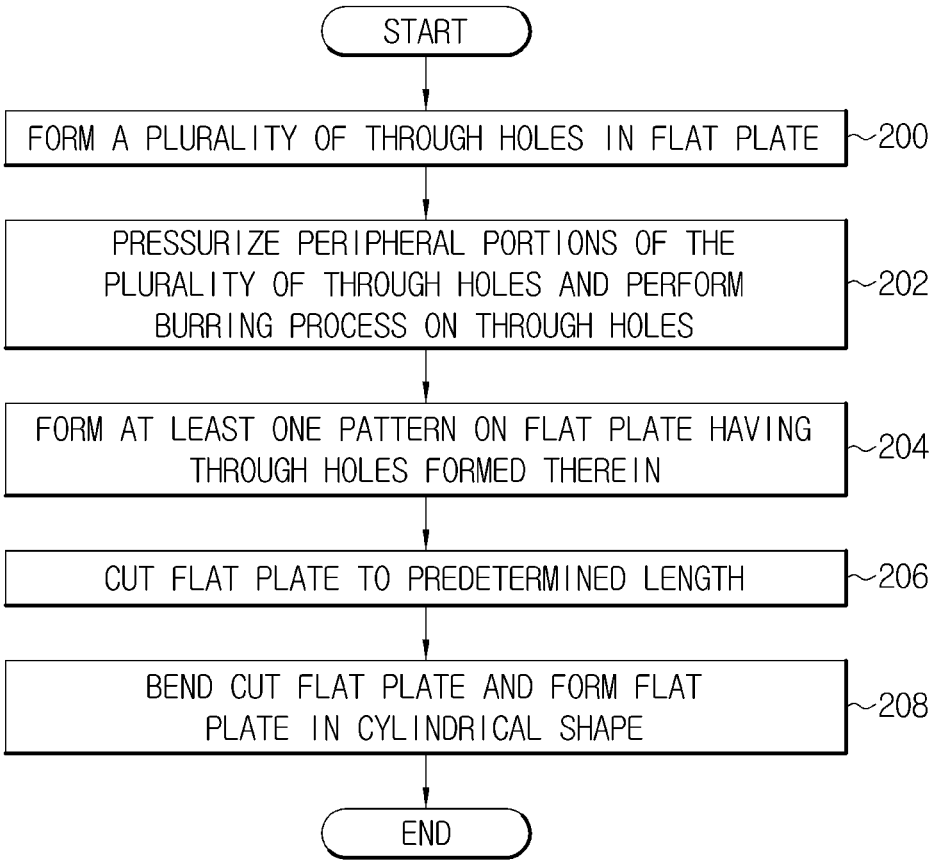
FIG. 7 is a flowchart illustrating a method of manufacturing the washing tub being provided in the washing machine, according to an embodiment.

FIG. 7 is a flowchart illustrating a method of manufacturing the washing tub 30 provided in the washing machine 1, according to an embodiment.

A plurality of through holes 150 are formed in a flat plate provided to have a predetermined thickness (200). For example, the flat plate is punched to have sharp ends so that the through holes 150 can be formed in the flat plate. The shape or position of the through holes 150 may be provided in various ways according to a design.

Peripheral portions 152 of the through holes 150 are pressurized, and a burring process is performed on the through holes 150 (202). This is to prevent the through holes 150 having sharp ends from being formed in the inner side surface 110 that directly contacts the laundry. Thus, a first surface that constitutes the inner side surface 110 of the washing tub 30 is first pressurized and then, a second surface that constitutes the outer side surface 120 is pressurized so that the burring process can be performed on the through holes 150.

At least one pattern is formed on the flat plate having the through holes 150 formed therein by pressurizing the flat plate (204). The at least one pattern may include the plurality of protrusions 130 and the plurality of concave sides 140 described above. In an embodiment, the plurality of protrusions 130 may be formed to protrude from the first surface, and the plurality of concave sides 140 may be formed to be recessed into the first surface.

In order to form the protrusions 130 and the concave sides 140, the flat plate having the through holes 150 formed therein may be pressurized at the first and second surfaces. In an embodiment, the first protrusions 132 and the concave sides 140 may be simultaneously formed. The protrusions 130 and the concave sides 140 may be provided in various positions and shapes according to a design.

The flat plate having the patterns and the through holes 150 formed therein is cut to a predetermined length (206). The cut flat plate is bent and is formed in a cylindrical shape so that the first surface becomes the inner side surface 110 (208). In this sequence, a cylindrical portion having the patterns and the through holes 150 formed therein can be manufactured.

As described above, a frictional force with laundry is generated using a washing tub including a plurality of protrusions and a plurality of concave sides so that a washing force can be enhanced and a flow of washing water can be guided.

Also, the level of washing water can be increased along the plurality of concave sides that extend from one end to the other end of the washing tub so that a dehydration force can be enhanced.

Although a few embodiments of a washing machine have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a casing;

a tub installed in the casing; and a washing tub rotatably installed in the tub and having an inner side surface which is configured to comprise:

a plurality of concave sides formed to be recessed into at least a portion of the inner side surface of the washing tub; and a plurality of protrusions formed on the plurality of concave sides, the plurality of protrusions protrude in an inward direction of the washing tub from the plurality of concave sides.

2. The washing machine of claim 1, wherein the plurality of concave sides are formed to extend from one end to the other end of a cylindrical portion of the washing tub so as to guide a flow of washing water.

3. The washing machine of claim 2, wherein the plurality of concave sides extend to be inclined to one side.

4. The washing machine of claim 3, wherein:

the plurality of concave sides are formed to be inclined in an opposite direction to a dehydration direction of the washing tub.

5. The washing machine of claim 2, wherein the plurality of concave sides are formed to extend in a swirl shape.

6. The washing machine of claim 2, wherein the plurality of concave sides extend in a form of a curve, and a curvature of the curve varies.

7. The washing machine of claim 2, wherein the plurality of concave sides extend in a form of a curve from a lower portion of the washing tub to an upper portion of the washing tub at a first angle, a second angle and a third angle.

8. The washing machine of claim 7, wherein the first angle and the third angle are equal to each other and inclined at a larger angle than the second angle with respect to a bottom surface of the washing tub.

9. The washing machine of claim 1, wherein:

the plurality of protrusions are disposed to be spaced apart from each other by a predetermined gap, and exterior parts of the plurality of protrusions are provided in a circular shape.

10. The washing machine of claim 1, wherein the plurality of protrusions are a plurality of first protrusions, and the inner side surface is further configured to comprise:

a plurality of second protrusions that protrude from the inner side surface of the washing tub.

11. The washing machine of claim 10, wherein the plurality of second protrusions protrude more in the inward direction of the washing tub than the plurality of first protrusions.

12. The washing machine of claim 1, wherein the plurality of concave sides extend along the plurality of protrusions.

13. The washing machine of claim 12, wherein:

the plurality of protrusions are provided to have a plurality of rows and columns, and each of the concave sides extends along each of the protrusions arranged in different rows and columns.

14. The washing machine of claim 1, further comprising a plurality of through holes provided between the plurality of protrusions so as to perform drainage of the washing tub, wherein the plurality of protrusions are disposed to be spaced apart from each other by a predetermined gap.

15. The washing machine of claim 14, wherein:

the plurality of through holes are placed adjacent to each of the plurality of protrusions, and the plurality of through holes placed adjacent to each of the plurality of protrusions are disposed to have a predetermined angle.

16. A washing machine comprising:

a tub; and a washing tub rotatably installed in the tub and configured to rotate around a vertical shaft, the washing tub having an inner side surface comprising:

a plurality of protrusions that protrude in an inward direction of the washing tub; and a plurality of concave sides formed to be recessed into at least a portion of the inner side surface of the washing tub and at least portions of the plurality of protrusions are formed on the plurality of concave sides and configured to protrude from the plurality of concave sides.

17. The washing machine of claim 16, wherein each of the plurality of concave sides extends to be inclined to one side along the plurality of protrusions.

18. The washing machine of claim 17, wherein:

the plurality of protrusions are provided to have a plurality of rows and columns, and each of the protrusions provided in different rows and columns is disposed at each of the plurality of concave sides.

19. The washing machine of claim 16, further comprising a plurality of through holes provided adjacent to each of the plurality of protrusions so as to perform drainage of the washing tub, wherein the plurality of through holes adjacent to each of the plurality of protrusions are disposed to be spaced apart from each other at a predetermined angle.

20. The washing machine of claim 16, further comprising a plurality of through holes provided adjacent to each of the protrusions so as to perform drainage of the washing tub, wherein at least portions of both the plurality of protrusions and the plurality of through holes are disposed in each of the concave sides.

* * * * *